US010478842B2

(12) United States Patent
Kang

(10) Patent No.: US 10,478,842 B2
(45) Date of Patent: Nov. 19, 2019

(54) AUTO-OPEN COMPACT CONTAINER

(71) Applicant: Seong Il Kang, Seongnam-si (KR)

(72) Inventor: Seong Il Kang, Seongnam-si (KR)

( * ) Notice: Subject to any disclaimer, the term of this patent is extended or adjusted under 35 U.S.C. 154(b) by 178 days.

(21) Appl. No.: 15/573,295

(22) PCT Filed: May 10, 2016

(86) PCT No.: PCT/KR2016/004868
§ 371 (c)(1),
(2) Date: Nov. 10, 2017

(87) PCT Pub. No.: WO2016/182312
PCT Pub. Date: Nov. 17, 2016

(65) Prior Publication Data

US 2018/0085767 A1 Mar. 29, 2018

(30) Foreign Application Priority Data

May 12, 2015 (KR) ..... 10-2015-0065804

(51) Int. Cl.
*B05B 11/00* (2006.01)
*B65D 43/26* (2006.01)
(Continued)

(52) U.S. Cl.
CPC ..... *B05B 11/0044* (2018.08); *A45D 33/006* (2013.01); *A45D 33/025* (2013.01);
(Continued)

(58) Field of Classification Search
CPC ..... B65D 43/16; B65D 43/22; B65D 43/163; B65D 43/26; B65D 77/06; B65D 77/00; B65D 77/04; A45D 33/006; A45D 33/008; A45D 33/025; A45D 33/34; A45D 33/003; A45D 34/042; A45D 34/00; A45D 40/22;
(Continued)

(56) References Cited

U.S. PATENT DOCUMENTS

2006/0118454 A1* 6/2006 Kang ..... A45D 33/006 206/581
2016/0073761 A1* 3/2016 Lee ..... A45D 33/025 132/298
(Continued)

FOREIGN PATENT DOCUMENTS

KR 20-1994-0006733 Y1 9/1994
KR 20-0461424 Y1 7/2012
(Continued)

*Primary Examiner* — Andrew D Perreault
(74) *Attorney, Agent, or Firm* — Novick, Kim & Lee, PLLC; Jae Youn Kim

(57) ABSTRACT

An auto-open compact container has an outer container having a button formed on one side thereof, an outer container lid hinge-coupled to one side of the outer container to be opened/closed, and an inner container which is mounted inside the outer container. An air inlet protrusion is formed in the button such that external air is introduced into the inner container simultaneously while the button is pressed to open the outer container lid. Therefore, an inside of the inner container, which is sealed and evacuated, communicates with the outside, thereby making an operation of pressing the discharge plate smooth.

2 Claims, 4 Drawing Sheets

(51) Int. Cl.

| | |
|---|---|
| ***B65D 43/16*** | (2006.01) |
| ***A45D 40/00*** | (2006.01) |
| ***A45D 40/22*** | (2006.01) |
| ***B65D 77/04*** | (2006.01) |
| ***B65D 43/22*** | (2006.01) |
| ***B65D 47/00*** | (2006.01) |
| ***A45D 33/00*** | (2006.01) |
| ***A45D 33/02*** | (2006.01) |

(52) U.S. Cl.
CPC ..... *A45D 40/00* (2013.01); *A45D 40/0075* (2013.01); *A45D 40/222* (2013.01); *B05B 11/3002* (2013.01); *B05B 11/3073* (2013.01); *B65D 43/163* (2013.01); *B65D 43/22* (2013.01); *B65D 43/26* (2013.01); *B65D 47/00* (2013.01); *B65D 77/04* (2013.01); *A45D 2200/051* (2013.01); *A45D 2200/055* (2013.01); *B05B 11/007* (2013.01); *B05B 11/0032* (2013.01); *B05B 11/3077* (2013.01)

(58) Field of Classification Search
CPC .. A45D 40/00; A45D 40/0075; A45D 40/222; A45D 40/3073; A45D 2040/0006; A45D 2040/225; A45D 2200/056; A45D 2200/10; A45D 2200/051; A45D 2200/055; B05B 11/0044; B05B 11/3002; B05B 11/0032; B05B 11/007; B05B 11/3077
USPC ..... 206/581
See application file for complete search history.

(56) References Cited

U.S. PATENT DOCUMENTS

| | | | | |
|---|---|---|---|---|
| 2017/0280853 | A1* | 10/2017 | Castex | A46B 11/0006 |
| 2018/0116371 | A1* | 5/2018 | Kim | A45D 34/00 |
| 2018/0279741 | A1* | 10/2018 | Oh | A45D 34/00 |
| 2019/0150591 | A1* | 5/2019 | Song | A45D 33/006 |

FOREIGN PATENT DOCUMENTS

| | | | |
|---|---|---|---|
| KR | 10-1171305 | B1 | 8/2012 |
| KR | 10-2013-0048082 | A | 5/2013 |
| KR | 20-2015-0000596 | U | 2/2015 |

* cited by examiner

AUTO-OPEN COMPACT CONTAINER

CROSS-REFERENCE(S) TO RELATED APPLICATION

This is a 371 application of PCT/KR2016/004868 filed May 10, 2016, which claims priority of Korean Patent Application No. KR 10-2015-0065804, filed on May 12, 2015, in the Korean Intellectual Property Office, which is hereby incorporated by reference in its entirety.

BACKGROUND OF THE INVENTION

Field of the Invention

The present disclosure relates to an auto-open compact container, and more particularly, to an auto-open compact container in which as external air is introduced into an inner container simultaneously while a button is pressed to open an outer container lid, a space in the inner container, which is sealed and evacuated, communicates with the outside, thereby making a pressing operation of a discharge plate smooth.

Description of the Related Art

In general, in a compact container, solid powder is accommodated in a container having a predetermined shape, and when the compact container is used, the powder is put in a puff which is an applicator accommodated in the compact container, and is applied to a face using the puff.

However, when the solid powder is used as a compact, the solid powder flies, and when the solid powder is applied to the face, a contact feeling slightly deteriorates.

Thus, in order to overcome such a disadvantage, a gel-like compact obtained by mixing the solid powder with a volatile material has been developed. Further, the frequency of use of the compact is increasing due to convenience thereof.

However, when such a gel-like compact is exposed to the outside, because the volatile material is evaporated into the atmosphere, the powder is hardened or is broken due to cracking.

In this way, an inner space should be sealed from the outside such that the gel-like compact is not hardened because the volatile material is evaporated to the outside.

A compact container in which a volatile material is evaporated from a stored gel-like compact has been developed as disclosed in Utility Model No. 461424 conceived to meet such a demand.

However, in the compact container, an outer container lid is opened, the puff is pressed to mix the gel-like compact with the powder, and a mixture thereof is used. Because the inner space of the compact container is sealed from the outside, the inner space is evacuated, and thus, a plate on which the puff is placed is not pressed.

SUMMARY OF THE INVENTION

The present disclosure is invented to meet the above-described related art, and an aspect of the present disclosure is to provide an auto-open compact container in which as external air is introduced into an inner container simultaneously while a button is pressed to open an outer container lid, a space in the inner container, which is sealed and evacuated, communicates with the outside, thereby making a pressing operation of a discharge plate smooth.

An auto-open compact container according to a first embodiment of the present disclosure may include: an outer container having a button formed on one side of the outer container; an outer container lid hinge-coupled to one side of the outer container to be opened/closed; an inner container which is mounted inside the outer container, and an upper rim of which is sealed by an annular packing member inserted into an inner periphery of the outer container lid; an inner container cover coupled to an upper portion of the inner container and having a cosmetic material suction hole formed at a center of the inner container cover; a pump installed at an upper portion of the inner container cover to pump a cosmetic material; and a discharge plate which is coupled to an upper side of the inner container cover to be vertically moved and coupled to an upper portion of the pump at the same time, and has a plurality of cosmetic material discharging holes formed therein, and an upper portion of which is exposed to the outside such that a user comes into contact with a puff, wherein the button includes: an air inlet protrusion integrally formed at an upper end of the button to push the annular packing member of the outer container lid by a pressing operation of the user so as to allow external air to be introduced into the inner container; a stopper protrusion integrally formed on an outer side of the upper end of the button and unstopped from a hook formed on one side of the outer container lid by a pressing operation of the user to open the outer container lid; and return springs protruding from opposite sides of the button in an arc shape to be symmetric to each other, and returning to original positions when the button is pressed and then unpressed while the return springs come into contact with an inner wall of the outer container.

The radius of curvature of the arc-shaped return springs may be smaller than the radius of curvature of the inner wall of the outer container.

In an auto-open compact container according to the present disclosure, an air inlet protrusion is provided in a button such that external air is introduced into an inner container simultaneously while the button is pressed to open an outer container lid. Therefore, an inner space of the inner container, which is sealed and evacuated, communicates with the outside, thereby making an operation of pressing a discharge plate smooth.

BRIEF DESCRIPTION OF THE DRAWINGS

The above and other aspects, features and advantages of certain exemplary embodiments of the present invention will be more apparent from the following description taken in conjunction with the accompanying drawings, in which.

DETAILED DESCRIPTION OF EXEMPLARY EMBODIMENTS

Hereinafter, exemplary embodiments of the present disclosure will be described in detail with reference to the accompanying drawings. Further, in description of the present disclosure, when it is determined that detailed descriptions of well-known configurations or functions make the subject matter the present disclosure unclear, the detailed descriptions will be omitted.

Embodiment

Figure 1:
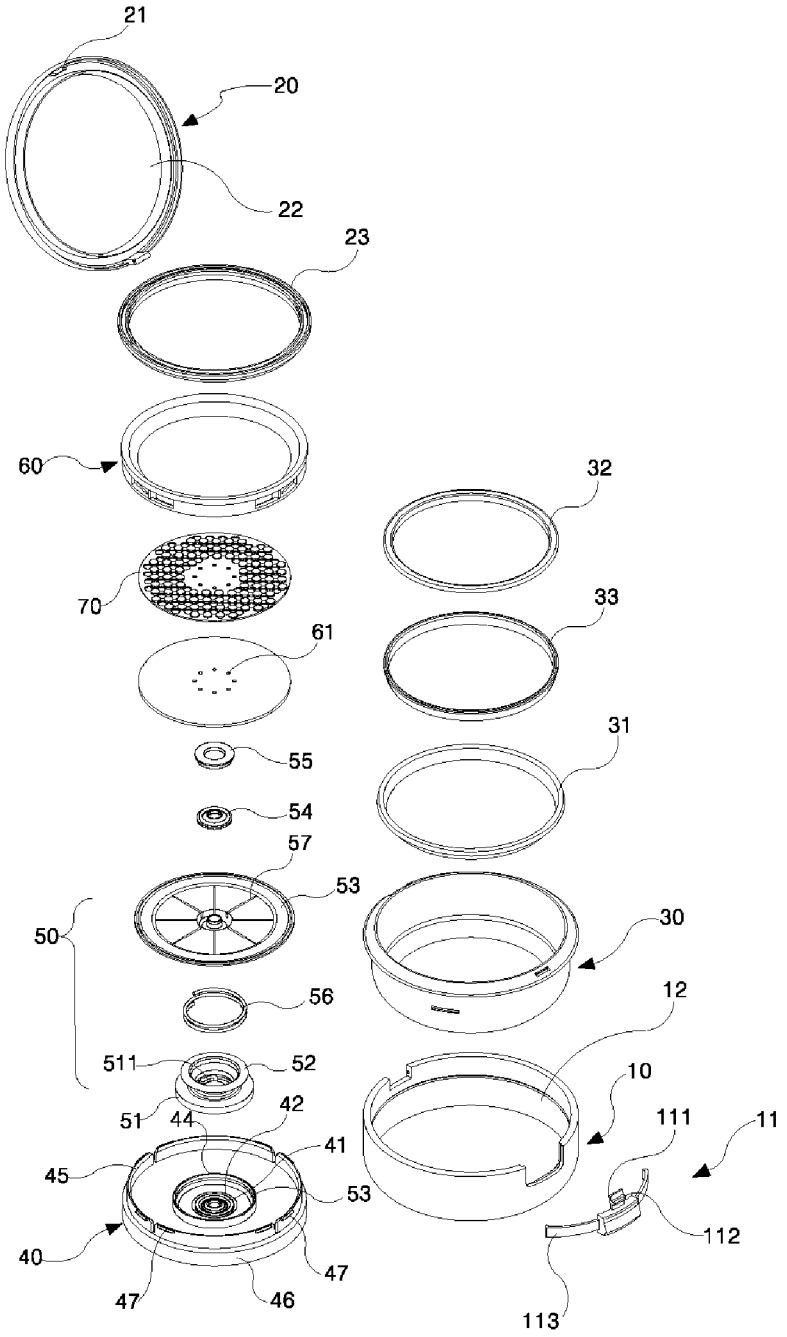
FIG. 1 is an exploded perspective view illustrating an auto-open compact container according to the present disclosure.
Figure 2:
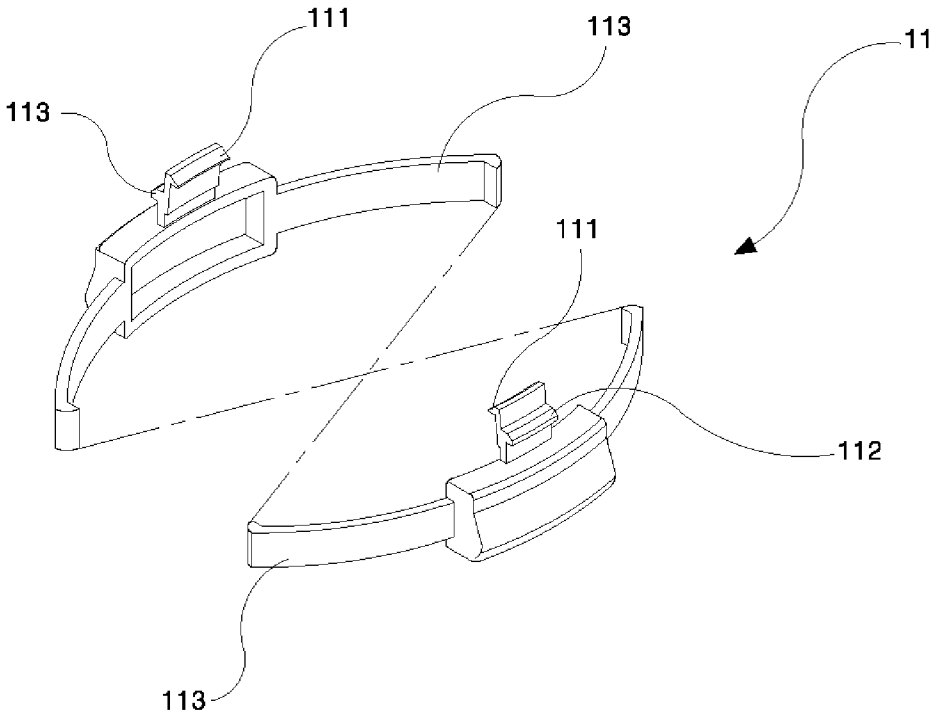
FIG. 2 is a detailed perspective view illustrating the auto-open compact container according to the present disclosure.
Figure 3:
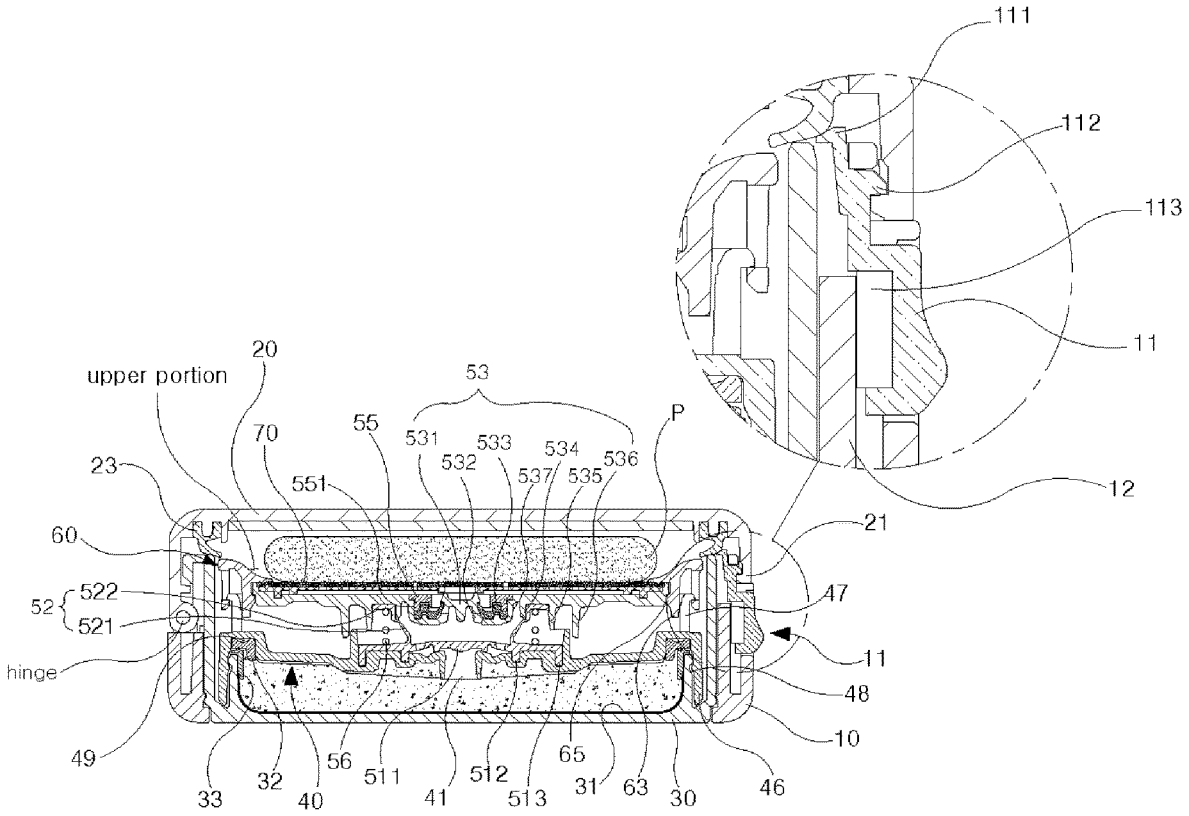
FIG. 3 is a sectional view illustrating a process of assembling the auto-open compact container according to the present disclosure.
Figure 4:
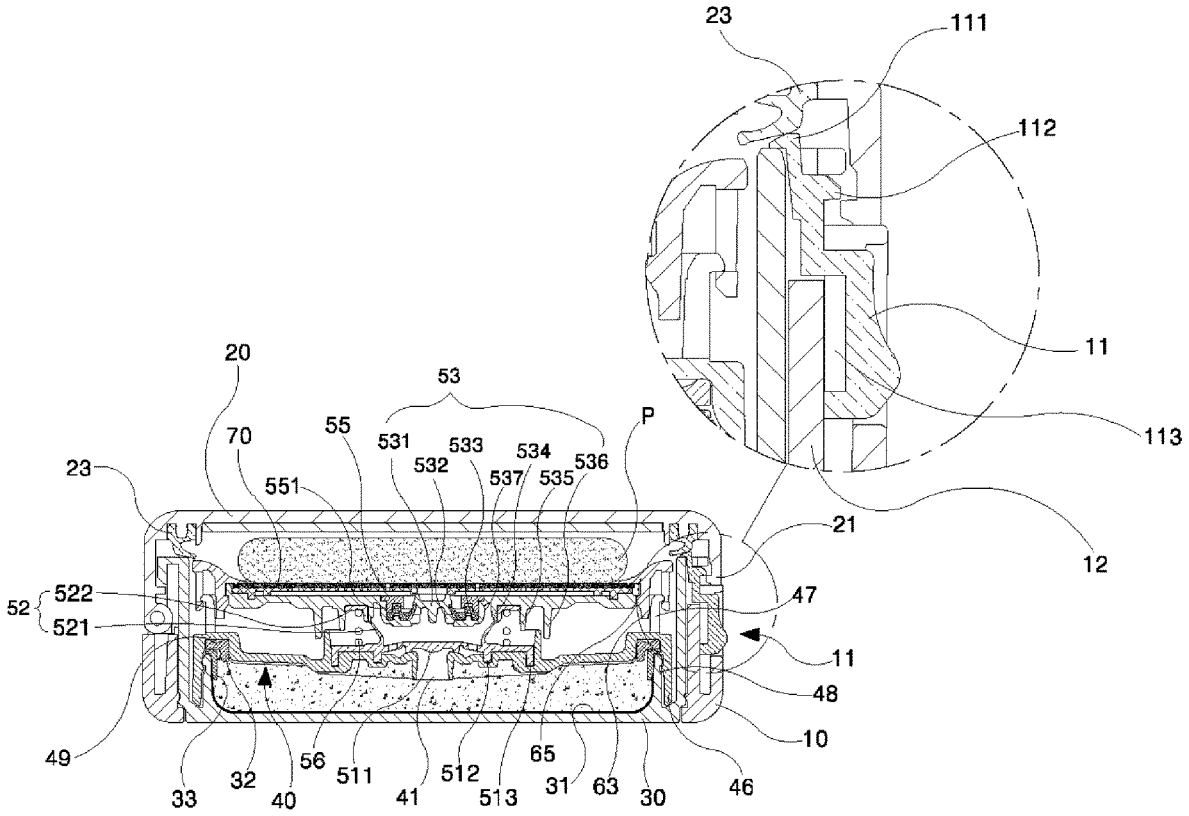
FIG. 4 is a sectional view illustrating a state in which a button of the auto-open compact container according to the present disclosure is pressed.

FIG. 1 is an exploded perspective view illustrating an auto-open compact container according to the present disclosure, FIG. 2 is a detailed perspective view illustrating the auto-open compact container according to the present disclosure, FIG. 3 is a sectional view illustrating a process of assembling the auto-open compact container according to the present disclosure, and FIG. 4 is a sectional view illustrating a state in which a button of the auto-open compact container according to the present disclosure is pressed.

As illustrated in FIGS. 1 to 4, the auto-open compact container according to an embodiment of the present disclosure includes: an outer container 10 having a button 11 formed on one side thereof; an outer container lid 20 hinge-coupled to one side of the outer container 10 to be opened/closed; an inner container 30 which is mounted inside the outer container 10, and an upper rim of which is sealed by an annular packing member 23 inserted into an inner periphery of the outer container lid 20; an inner container cover 40 coupled to an upper portion of the inner container 30 and having a cosmetic material suction hole 41 formed at a center thereof; a pump 50 installed at an upper portion of the inner container cover 40 to pump a cosmetic material; and a discharge plate 60 which is coupled to the upper side of the inner container cover 40 to be vertically moved and coupled to an upper portion of the pump 50 at the same time, and has a plurality of cosmetic material discharging holes 61 formed therein, and an upper portion of which is exposed to the outside such that a user may come into contact with a puff P, wherein the button 11 includes: an air inlet protrusion 111 integrally formed at an upper end thereof to push the annular packing member 23 of the outer container lid 20 by a pressing operation of the user to allow external air to be introduced into the inner container 30; a stopper protrusion 112 integrally formed on an outer side of an upper end thereof and unstopped from a hook 21 formed on one side of the outer container lid 20 by a pressing operation of the user to open the outer container lid 20; and return springs 113 protruding from opposite sides thereof to be symmetric to each other in an arc shape, and returning to original positions when the button 11 is pressed and then unpressed while the return springs 113 come into contact with an inner wall 12 of the outer container 10.

The radius of curvature of the arc-shaped return springs 113 is smaller than the radius of curvature of the inner wall 12 of the outer container 10.

Further, a mirror 22 is provided inside the outer container lid 20 so that the user may easily perform makeup.

A cosmetic material storage membrane 31 in a form of a soft thin film is further formed inside the inner container 30.

It is preferred that the cosmetic material storage membrane 31 is made of one or more of polyethylene phthalate (PET) resin, polyethylene, polypropylene, and thermoplastic elastomer.

A first sealing ring 32 and a second sealing ring 33 are coupled to each other between an upper end of the cosmetic material storage membrane 31 and the inner container cover 40 to improve a sealing force of a gel-like cosmetic material accommodated in the cosmetic material storage membrane 31 of the inner container 30.

Further, a cylindrical coupling protrusion 34 is formed in an inner periphery of a lower side of the inner container such that a lower extending protruding ring 46 of the inner container cover 40 is inserted and coupled thereto.

A first pump mounting groove 42 and a second pump mounting groove 43 on which the pump 50 is mounted are spaced apart from each other by a specific interval and are sequentially formed on an upper surface of an outer side of the cosmetic material suction hole 41.

A first upper extending protruding ring 44 extends upward from an outer side of the second pump mounting groove 43, a second upper extending protruding ring 45 is spaced a specific interval from and extends upward from an outer side of the first upper extending protruding ring 44, and the lower extending protruding ring 46 extends downward from the outer side of the second upper extending protruding ring 45.

A fastening protrusion 47 is formed on the upper side of the second upper extending protruding ring 45, and a coupling protrusion 48 is formed in an inner periphery of the lower side of the lower extending protruding ring 46 and is coupled to the cylindrical coupling protrusion 34 of the inner container 30.

Further, a sealing ring inserting groove 49 into which the first sealing ring 32 and the second sealing ring 33 are inserted is formed inside the lower extending protruding ring 46.

The pump 50 includes a pump base plate 51 having a suction pump 511 formed at the center thereof, a pump body 52 integrally extending from an upper portion of the pump base plate 51, a pump top plate 53 coupled to an upper portion of the pump body 52, a discharge valve 54 coupled to an upper central portion of the pump top plate 53, a fixing member 55 configured to fix the discharge valve 54, and an elastic member 56 mounted between the pump base plate 51 and the pump body 52.

A suction valve 511 made of an elastic material and configured to selectively open/close the cosmetic material suction hole 41 of the inner container cover 40 is formed at the center of the pump base plate 51, and a first pump mounting protrusion 512 and a second pump mounting protrusion 513 inserted into the first and second pump mounting grooves 42 and 43 are spaced apart from each other by a specific distance and are sequentially formed on an outer side of the suction valve 511.

The pump body 52 is integrally formed at an upper portion of the pump base plate 51, and includes a cylindrical elastic support 521 made of an elastic material, and a transverse extending piece 522 transversely extending from an upper end of the elastic support 521.

The pump top plate 53 has a blocking member 531 formed at the center thereof, a plurality of cosmetic material discharging holes 532 formed in an outer periphery of a lower portion of the blocking member 531, and a top plate mounting protrusion 533 on which the discharge valve 54 is mounted on an outer side of the cosmetic material discharging holes 532.

Further, a first extension piece 534 is formed on the lower side of the pump top plate 53, a second extension piece 535 and a third extension piece 536 are sequentially formed outside the first extension piece 534, a transverse extension piece 522 of the pump body 52 is fitted between the first extension piece 534 and the second extension piece 535, and the third extension piece 536 is located outside the first upper extending protruding ring 44 of the inner container cover 40.

Further, a pump discharge space 57 in which cosmetic materials are filled is formed between an outer side of the blocking member 531 of the pump top plate 53 and the discharge plate 60, and a top plate coupling groove 537 to which the fixing member 55 is coupled is formed on an inner surface of the pump discharge space 57.

The discharge valve 54 is made of an elastic material to selectively open/close the cosmetic material discharging holes 532 while coming into contact with or being spaced apart from an outer periphery of the blocking member 531 of the pump top plate 53.

A discharge valve mounting groove 541 is formed on a lower surface of the discharge valve 54 and is coupled to a top plate mounting protrusion 533 of the pump top plate 53.

A fixing member coupling protrusion 551 is formed on an outer periphery of the fixing member 55, is coupled to the top plate coupling groove 537 of the pump top plate 53, and serves to fix the discharge valve 54.

The elastic member 56 is mounted between the upper surface of the pump base plate 51 and the transverse extension piece 522 of the pump body 52 to elastically support the transverse extension piece of the pump body 52 and the pump top plate 53.

The suction valve 511 of the pump base plate 51, the elastic support 521 of the pump body 52, and the discharge valve 54 is made of one selected from elastomer, silicone rubber, acrylonitrile-butadiene rubber (NBR), polyethylene, and polypropylene.

Further, a radial cosmetic material diffusing space 58 is formed at an upper end of the pump top plate 53 of the pump 50 such that the gel-like cosmetic material is widely spread and is discharged through the discharge plate 60.

The discharge plate 60 has an inner wall 63 coupled to the pump top plate 53 of the pump 50 and extending downward, and an outer wall 64 spaced outward apart from the inner wall 63, coupled to the inner container cover 40 to be vertically moved, and extending downward.

An inner wall protrusion 65 is formed in an inner periphery of the inner wall 63 and is coupled to an edge of the pump top plate 53, and an outer wall protrusion 66 is formed in an inner periphery of the outer wall 64 and is fastened to the fastening protrusion 47 of the inner container cover 40.

The cosmetic material discharging holes 61 of the discharge plate 60 is formed above the radial cosmetic material diffusing space 58.

An in-mold film 70 is attached to the upper surface of the discharge plate 60.

The upper surface of the in-mold film 70 is embossed. The embossing is various kinds of patterns or characters.

A method for assembling the above-described auto-open compact container according to the present disclosure will be described below.

In order to assemble the auto-open compact container according to the present disclosure, first, the inner container 30 in which the cosmetic material storage membrane 31 is installed is fitted in the outer container 10, and then a cosmetic material is injected into the cosmetic material storage membrane 31.

Next, the inner container cover 40 is fixed and installed in an upper portion of the inner container 30, to seal the inner container 30. The first and second sealing rings 31 and 32 may be further coupled between the inner container 30 and the inner container cover 40 to improve a sealing force.

Thereafter, the pump 50 is installed on the inner container cover 40. In detail, the pump body 52 is integrally formed, the first pump mounting protrusion 512 and the second pump mounting protrusion 513 of the pump base plate 51 having the elastic member 56 mounted on an outer side thereof are inserted into the first and second pump mounting grooves 42 and 43 of the inner container cover 40, the pump top plate 53 is coupled to an upper portion of the pump body 42, and the transverse extension piece 522 of the pump body 52 is fitted between the first extension piece 534 and the second extension piece 535 of the pump top plate 53.

Next, the discharge valve 54 is mounted on an outer side of the blocking member 531 of the pump top plate 53, and after the fixing member 55 is coupled to prevent separation of the discharge valve 54, the discharge plate 60 is coupled to the pump top plate 5 and an upper portion of the inner container cover 40 to be vertically moved.

Finally, the outer container lid 20 is hinge-coupled to one side of the outer container 10. The assembling of the auto-open compact container according to the present disclosure is completed.

Use of the above-described auto-open compact container will be described below.

In order to use the auto-open compact container, first, when the button 11 on a side surface of the container is pressed, the air inlet protrusion 111 protruding from an upper end of the button 11 pushes up the annular packing member 23 coupled to an inner periphery of the outer container lid 20, that is, a gap between the air inlet protrusion 111 and an upper circumference of the inner container 30 is formed. In this case, air is introduced into the inner container 30 through the gap, so that an sealed inside of the inner container 30 communicates with the outside.

At the same time, the stopper protrusion 112 pushes up the hook 21 of the outer container lid 20 to open the outer container lid 20.

In this way, in a state in which the outer container lid 20 is opened, the puff P is used to press the discharge plate 60.

When the discharge plate 60 is pressed, the pump top plate 53 coupled to a lower portion of the discharge plate 60 is moved downward. Further, while the pump body 52 is pressed by the downward movement of the pump top plate 53, the elastic support 521 of the pump body 52 is folded, and at the same time, the volume of a temporary cosmetic material storage space is reduced. Accordingly, a pressure is generated in the temporary cosmetic material storage space, and as a cosmetic material in the temporary cosmetic material storage space is to be discharged to the outside by the pressure, a discharge pressure is generated, so that the suction valve 511 of the pump base plate 51 closes the cosmetic material suction hole 41 of the inner container cover 40.

At the same time, the discharge valve 54 made of an elastic material and being in close contact with an outer surface of the blocking member 531 of the pump top body 53 is spaced apart from the blocking member 531 by the cosmetic material in the temporary cosmetic material storage space, to open the cosmetic material discharging holes 532. Further, the cosmetic material is discharged through the cosmetic material discharging holes 532 and is then introduced into the cosmetic material diffusing space 58.

After the cosmetic material is fully filled in the cosmetic material diffusing space 58, the cosmetic material is simultaneously discharged through the plurality of cosmetic material discharging holes 61 formed in the discharge plate 60.

Thereafter, when the discharge plate 60 is decompressed, as the shape of the elastic support 521 of the pump body 52 is restored by elasticity of the elastic member 56 and the elastic support 521, the volume of the temporary cosmetic material storage space increases, so that a vacuum pressure is generated.

Accordingly, the discharge valve comes into contact with the blocking member 531 of the pump top plate 53 to close the cosmetic material discharging holes 532, and at the same time, as the suction valve 511 of the pump base plate 51 is lifted up by the vacuum pressure generated in the temporary cosmetic material storage space, the cosmetic material suction hole 41 of the inner container cover 40 is opened. Because of this, contents accommodated in the cosmetic material storage membrane 31 of the inner container 30 is introduced into a temporary content storage space through the cosmetic material suction hole 41.

As described above, although the detailed embodiments have been described in the detailed description of the present disclosure, it is obvious that the technology of the present disclosure is easily modified by those skilled in the art, and the modified embodiments are included in the technical spirit claimed in the appended claims of the present disclosure.

What is claimed is:

1. An auto-open compact container comprising:

an outer container having a button formed on one side of the outer container;

an outer container lid comprising a hinge and a hook, wherein the hinge is coupled to one side of the outer container to be opened or closed;

an inner container which is mounted inside the outer container, and an upper rim of which is sealed by an annular packing member inserted into an inner periphery of the outer container lid;

an inner container cover coupled to an upper portion of the inner container and the inner container cover comprises a cosmetic material suction hole formed at a center of the inner container cover;

a pump installed at an upper portion of the inner container cover to pump a cosmetic material; and a discharge plate which is coupled to an upper side of the inner container cover to be vertically moved and concurrently coupled to an upper portion of the pump, wherein the discharge plate comprises a plurality of cosmetic material discharging holes formed in the discharge plate, and the discharge plate comprises an upper portion of which is exposed to an outside such that a user comes into contact with a puff, wherein the button comprises:

an air inlet protrusion integrally formed at an upper end of the button to push the annular packing member of the outer container lid by a pressing operation of the user so as to allow external air to be introduced into the inner container;

a stopper protrusion integrally formed on an outer side of the upper end of the button and unstopped from the hook formed on one side of the outer container lid by a pressing operation of the user to open the outer container lid; and return springs protruding from opposite sides of the button in an arc shape to be symmetric to each other, and returning to original positions when the button is pressed and then unpressed while the return springs come into contact with an inner wall of the outer container.

2. The auto-open compact container of claim 1, wherein a radius of curvature of each of the arc-shaped return springs is smaller than a radius of curvature of the inner wall of the outer container.

* * * * *